US005975557A

United States Patent [19]

Snoke et al.

[11] Patent Number: 5,975,557

[45] Date of Patent: Nov. 2, 1999

[54] CALF SUPPORT ON SNOWBOARD BINDING OR SNOWBOARD BOOT

[75] Inventors: Shawn C. Snoke, Big Bear City, Calif.; Shaw Kaake, Zurich, Switzerland

[73] Assignee: Marker Deutschland GmbH, Eschenlohe, Germany

[21] Appl. No.: 09/008,038

[22] Filed: Jan. 16, 1998

[30] Foreign Application Priority Data

Jan. 17, 1996 [DE] Germany ..... 297 00 632 U

[51] Int. Cl.[6] ..... A63C 9/10

[52] U.S. Cl. ..... 280/624; 280/14.2; 280/611; 36/119

[58] Field of Search ..... 280/642, 14.2, 280/611, 619, 620, 11.36, 626, 628, 629, 624; 36/119, 89

[56] References Cited

U.S. PATENT DOCUMENTS

| | | | |
|---|---|---|---|
| 3,272,524 | 9/1966 | Cubberley | 280/620 |
| 3,870,325 | 3/1975 | Davis | 280/611 |
| 4,864,743 | 9/1989 | Begey et al. | 36/119 |
| 5,356,170 | 10/1994 | Carpenter et al. | 280/618 |
| 5,609,347 | 3/1997 | Dressel | 280/14.2 |
| 5,692,765 | 12/1997 | Laughlin | 280/619 |
| 5,727,797 | 3/1998 | Bowles | 280/14.2 |
| 5,820,139 | 10/1998 | Grindl | 280/14.2 |

FOREIGN PATENT DOCUMENTS

| | | | |
|---|---|---|---|
| 0 753 269 A1 | 1/1997 | European Pat. Off. . | |
| 2 732 230 | 3/1995 | France . | |
| 44 16 023 C1 | 5/1994 | Germany . | |
| WO 96/17660 | 6/1996 | WIPO . | |
| WO96/17660 | 6/1996 | WIPO | A63C 9/18 |

*Primary Examiner*—Paul N. Dickson
*Assistant Examiner*—Lynda Jasmin
*Attorney, Agent, or Firm*—D. Peter Hochberg

[57] ABSTRACT

A calf rest arranged tiltably about a transverse axis on a heel stirrup or heel part of a snowboard binding or of a snowboard boot has, to limit the tiltability, an adjustable stop arrangement which interacts with the heel stirrup or heel part. This stop arrangement is arranged on the calf-side inner side of the calf rest, so that the stability of the mounting of the stop arrangement on the calf rest is increased by pressure of the calf against the calf rest.

14 Claims, 5 Drawing Sheets

CALF SUPPORT ON SNOWBOARD BINDING OR SNOWBOARD BOOT

BACKGROUND OF THE INVENTION

1. Field of the Invention

The present invention relates generally to a calf support on a snowboard binding or a snowboard boot, and more particularly to a calf support with a base part extending under the foot of the snowboarder and with a heel stirrup or heel part arranged on the base part and a calf rest that is arranged tiltably about a transverse axis on the heel stirrup or heel part, the tiltability of which is in the backward direction and is limited by a stop, that is arranged on the calf rest and interacts with an edge on the heel stirrup or heel part.

2. Description of Prior Art

As described in U.S. Pat. No. 5,356,170, a snowboard binding, with a calf support as mentioned above, is known, which is suitable for soft or flexible boots (soft boots). By way of a base part, this binding has a base plate which can be mounted firmly on the snowboard, and can be used as a tread surface in each case for one boot and is fastened on the snowboard by means of a disk shaped hold-down plate. The hold-down plate can be inserted into a circular opening of the base plate, the underside of which overlaps with a flange-like rim at an annular region of the base plate at the circumference of the circular opening. The base plate can be secured between the upper side of the snowboard and the flange-like rim of the hold-down plate when the hold-down plate is screwed together with or otherwise firmly connected to the snowboard. The flange-like rim of the hold-down plate that overlaps the rim of the circular opening of the base plate, can be provided with a profile designed in the manner of a radial serration, which engages in an oppositely matching profile on the upper side of the rim of the opening of the base plate, so that the base plate can be fixed positively and non-positively on the snowboard by means of the hold-down plate.

According to U.S. Pat. No. 5,356,170, the pivot mounting of the calf rest on the heel stirrup is designed adjustably in such a manner that the calf rest can be arranged slightly to the side of the heel or calf center and the lower leg of the snowboarder is supported by a lateral component of greater or lesser magnitude during backward leaning.

Moreover, snowboard boots are also known, which have a base part which is designed as a relatively rigid sole or foot shell and can be inserted into a binding on the snowboard, which is preferably designed as a step-in binding. In this connection, a stable heel stirrup or heel part, which then in turn serves for mounting or fastening a calf rest on the boot, can be arranged or formed integrally on the sole or on the foot shell.

SUMMARY OF THE INVENTION

In accordance with a preferred embodiment of the present invention, a calf support is provided with a stop that is designed on a stop piece with which a stop arrangement is mounted vertically adjustably on the calf-side inner side of the calf rest. The stop arrangement extends downward beyond the lower edge of the calf rest on the same side as the heel stirrup or heel part.

The invention is based on the general idea that, in a calf rest with adjustable tiltability in the backward direction, strengthening the mounting of the tiltability-limiting stop arrangement on the calf rest by means of the pressure forces that are active between boot or calf and calf rest. In the case of the invention, these pressure forces lead to an increase in the contact pressure of the stop arrangement against the calf rest because the stop arrangement is arranged on the calf-side inner side of the calf rest.

According to a particular aspect of the preferred embodiment, the stop arrangement forms, with its side facing the boot, a shell which continues on the inner side of the calf rest and according to the adjustment of the stop arrangement, lengthens the calf rest downward to a greater or lesser extent. As a result, the calf or the rear side of the boot always have, during backward leaning of the snowboarder, a contact surface which is continued without interruption into the region of the heel stirrup or heel part, the shell being able, in the backwardly pivoted end position of the calf rest, i.e. the stop piece of the stop arrangement bears against the associated edge of the heel part, to cover virtually completely the heel stirrup or the heel part on its side facing the foot.

It is an object of this invention to improve the mounting and support of a calf rest.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
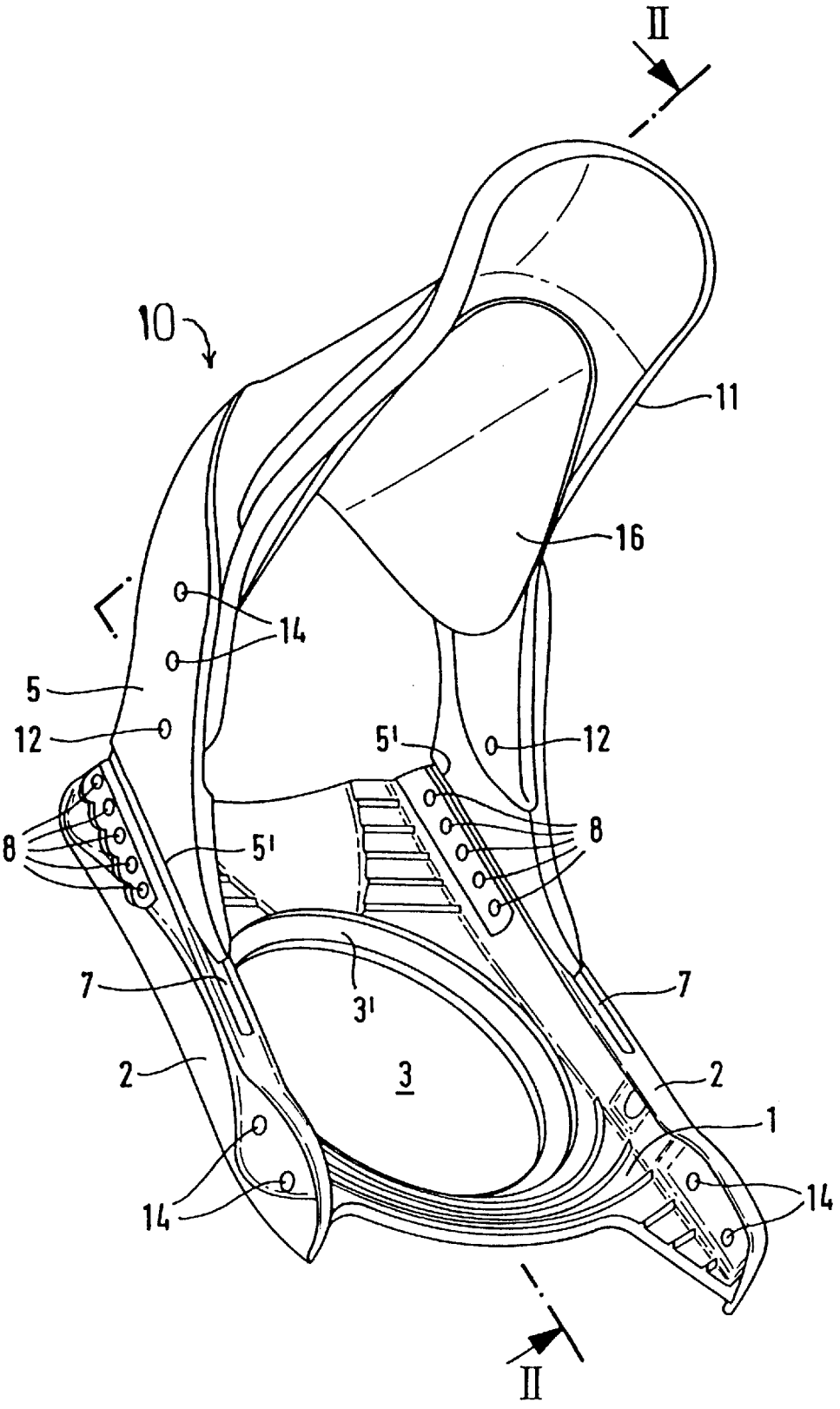
FIG. 1 is a perspective view of a snowboard binding with a calf support according to the invention.
Figure 2:
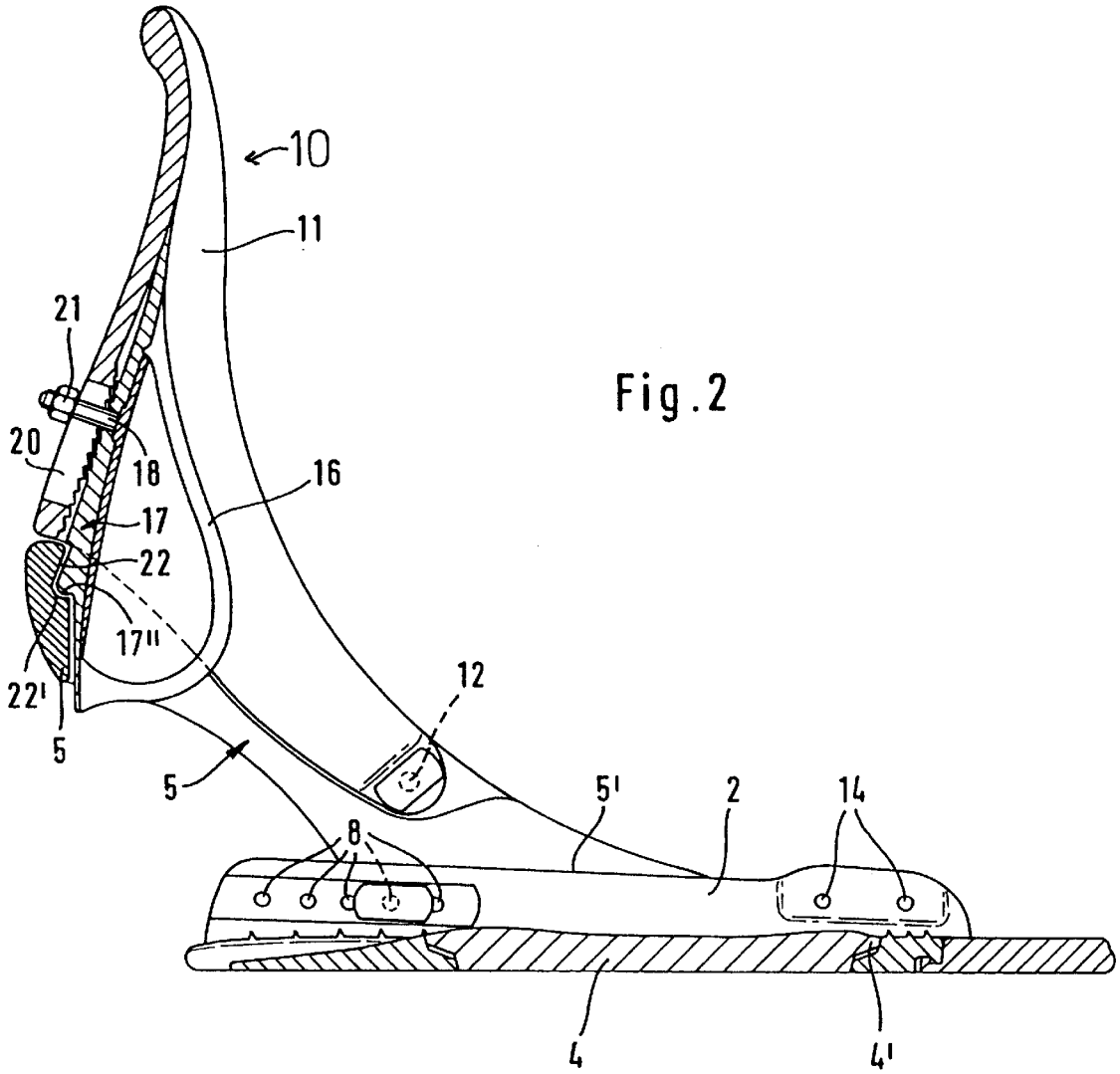
FIG. 2 is a longitudinal section along section line II—II in FIG. 1.
Figure 3:
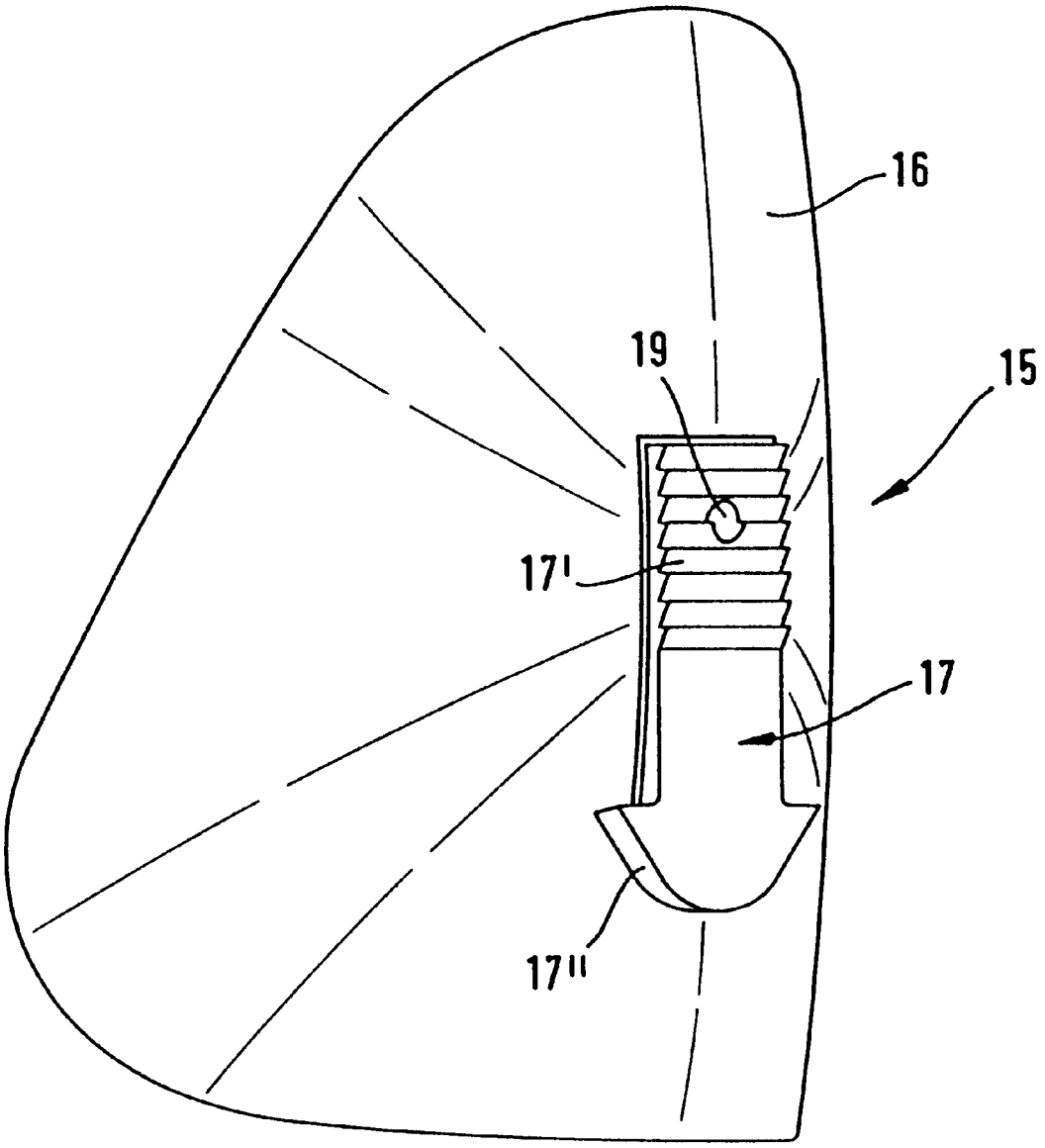
FIG. 3 is a rear view of the stop arrangement.

Referring now to the drawings wherein the showings are for the purpose of illustrating the preferred embodiment of the invention only, and not for the purpose of limiting the same, FIG. 1 and FIG. 2 show a calf support 10 where each binding is provided, for in each case one foot or one boot. Calf support 10 has a base plate 1 with longitudinal webs 2 at the edges, and a circular opening 3 with a serrated rim region 3'. A hold down plate or tension disk 4 can be inserted into circular opening 3, in which the disk covers the radially serrated rim region 3', of circular opening 3, with a flange-like rim 4'. The flange-like rim 4 has on its underside a serration that matches oppositely rim region 3'. By means of screws (not shown), tension disk 4 can be fastened on the upper side of a snowboard (not shown) or the like. The rim region 3' of circular opening 3 of base plate 1 being secured positively and non-positively between rim 4' of tension disk 4, and the upper side of the snowboard, so that base plate 1 is fixed immovably on the snowboard. A heel stirrup 5 is mounted adjustably on longitudinal webs 2.

Figure 4:
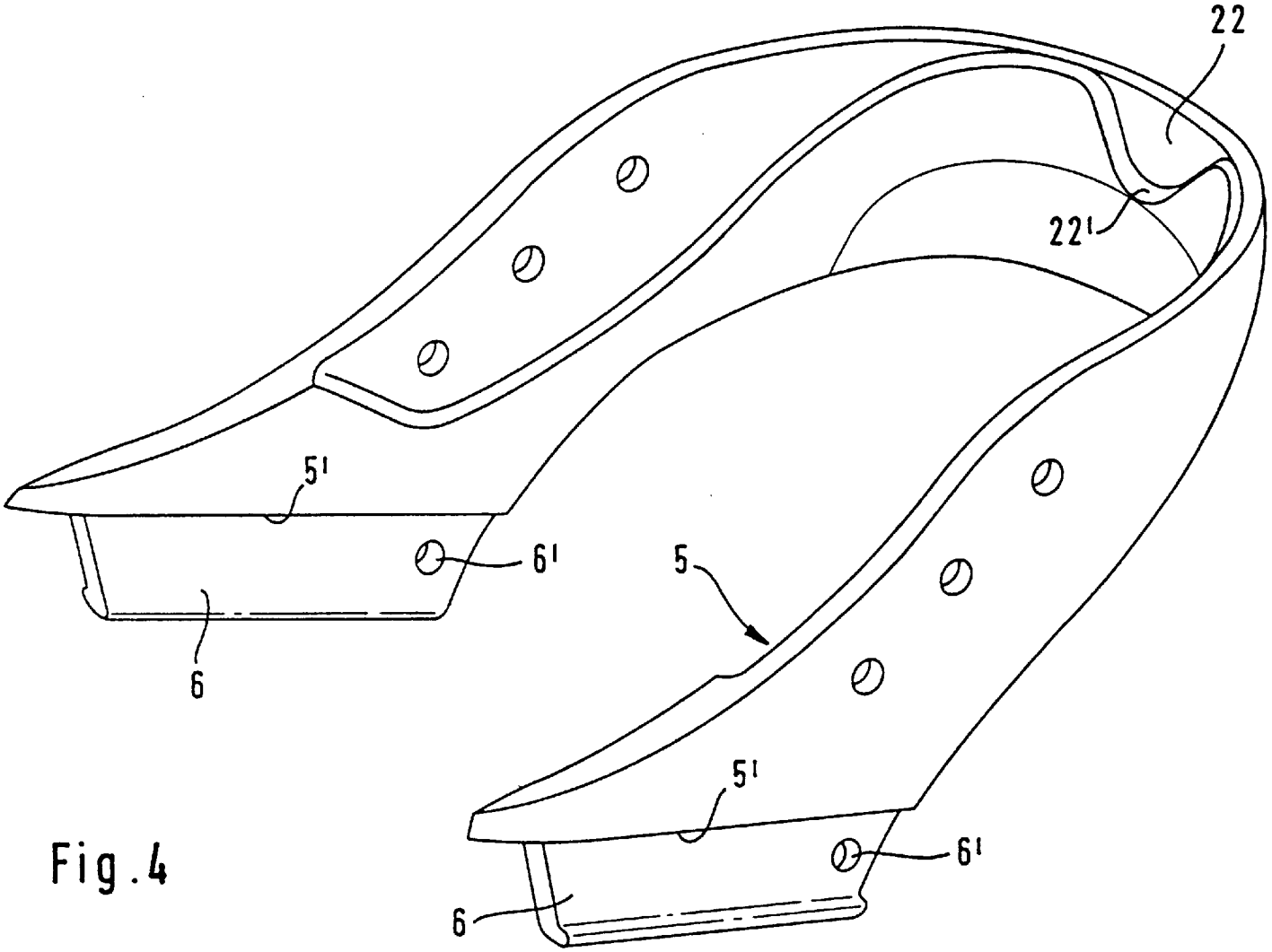
FIG. 4 is a perspective view of the heel stirrup.

According to FIG. 4, the ends of heel stirrup 5 connected to longitudinal webs 2, each have the shape of an angle profile 6 which is in each case received displaceably inside one of the longitudinal webs 2, in longitudinal slots 7. Longitudinal slots 7 have a corresponding angle profile or with an appropriately undercut profile, so that each angle profile 6 is displaceable in the manner of a slide inside the respective longitudinal slot 7 in the longitudinal direction of the respective longitudinal web 2. The slot correspondingly acts as a slide guide. The angle profiles 6 have a smaller wall thickness than the adjoining regions of heel stirrup 5, in such a manner, that in the transition region to angle profile 6, a pair of shoulders 5' are formed on heel stirrup 5 and extend beyond the upper edges of respective longitudinal web 2 on both sides of the profiles 6 corresponding slot 7.

Due to the positive interaction of the angle profiles with longitudinal slots 7, heel stirrup 5 is supported over a large area on longitudinal webs 2 in all transverse directions to the longitudinal direction of the longitudinal webs 2. Arranged on longitudinal webs 2 are rows of holes 8, in each case one hole of a row of holes 8 being aligned with a bore 6' in the respective angle profile 6, when the corresponding end of the heel stirrup 5 is moved into the associated position. This position can then be fixed by inserting a screw. The heel stirrup 5 has a certain degree of flexibility so that its ends can assume different positions on the two longitudinal webs 2.

A calf rest 11 is arranged pivotably on heel stirrup 5 about a transverse axis 12 that lies in a plane, which is roughly perpendicular to base plate 1 and contains the articulation axis of the ankle established by the ankle bones. Calf rest 11 can thus follow a forward inclination of the boot shaft or of the lower leg of the snowboarder to a very great extent without force, when the boot is inserted into the binding and fixed by strap loops (not shown) or the like. Calf rest 11 can be anchored at corresponding holes 14 of heel stirrup 5 and also at longitudinal webs 2. The backward pivoting of calf rest 11 is limited by a stop arrangement 15, which interacts with heel stirrup 5.

The stop arrangement 15 is arranged on the calf rest's inner side, facing the boot, and is designed as a shell part 16 that is slidable along the inner side of calf rest 11 and continues the inner side of calf rest 11 in the downward direction and lengthens calf rest 11 downward to a greater or lesser extent.

Formed integrally on the rear side of shell part 16 is a stop piece 17, with a sawtooth profile 17', which engages in an oppositely matching sawtooth profile on calf rest 11. Stop piece 17 and shell part 16 being mounted by a screw 18. Screw 18 passes through a hole 19 in shell part 16 and stop piece 17, respectively, and also passes through slot 20 in calf rest 11 and is fastened releasably on the outside of calf rest 11 by means of a nut 21 screwed onto screw 18. The length of slot 20 defines the adjustment range within which shell part 16 with stop piece 17 on calf rest 11 can be adjusted in the upward and downward directions.

Stop piece 17 has a stop edge 17" which, in all positions of stop piece 17 relative to calf rest 11, projects beyond the lower transverse edge of the latter and, during backward pivoting of calf rest 11, engages in a recess 22 on heel-stirrup's 5 inner side facing the boot and interacts there in the manner of a stop with an oppositely matching edge 22'. Recess 22 is designed in such a manner that it surrounds that part of stop piece 17 having stop edge 17" on the rear side of said part. Shell part 16 thus has, in the respective backwardly pivoted end position of calf rest 11, particularly secure and firm support in the heel region of the snowboarder.

The shell-part's 16 inner side, facing the boot, may be coated with a cushion-like material that may have a frictionally active surface, so that shell part 16 and thus calf rest 11 adhere to the rear side facing of the boot, and can follow closely a forward inclination of the boot shaft during corresponding forward inclination of the corresponding lower leg of the snowboarder. As a result, a largely constant contact pressure of calf rest 11 against the boot or the leg of the snowboarder.

Figure 5:
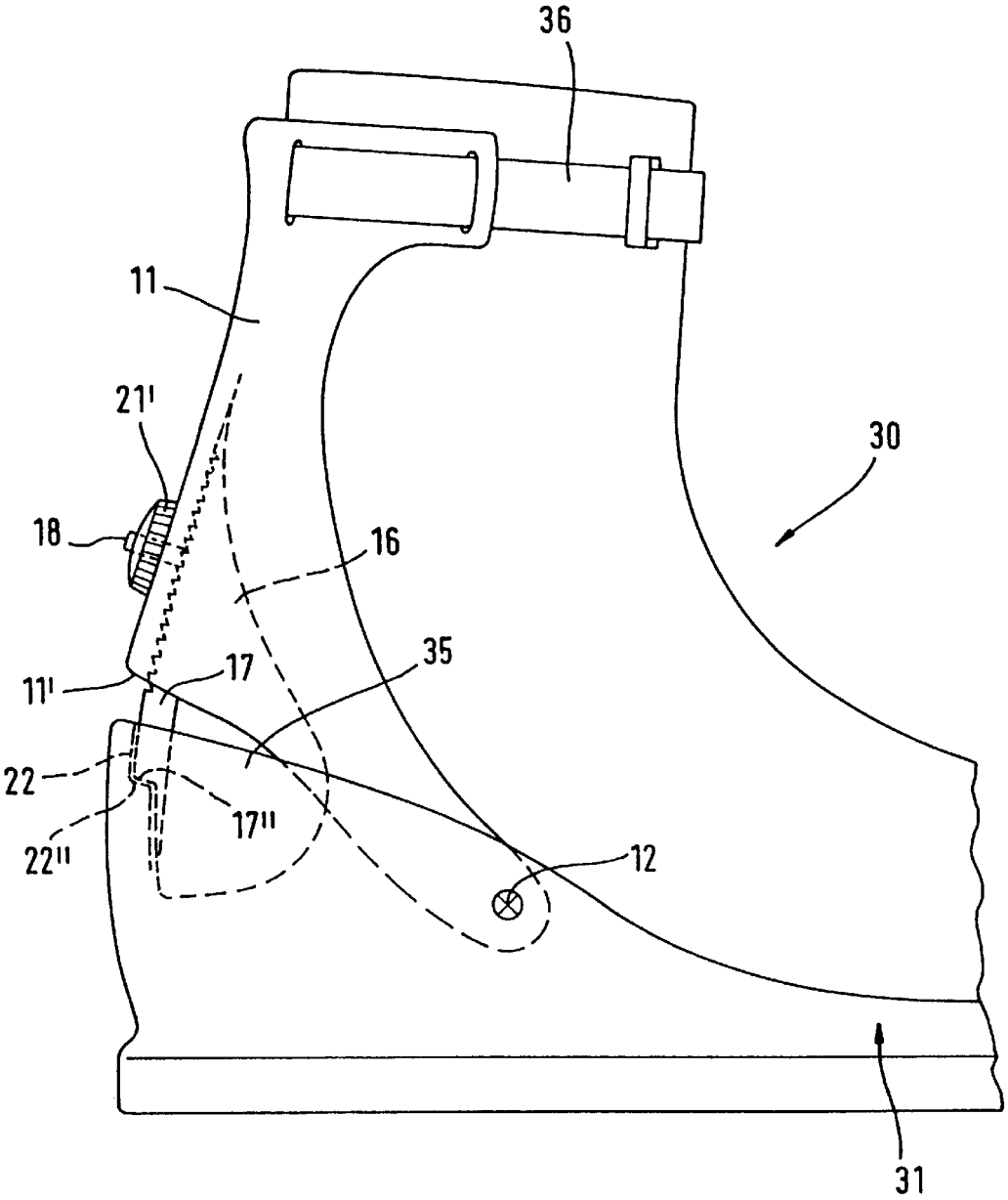
FIG. 5 is a snowboard boot with a calf support according to the invention.

According to FIG. 5, the calf support according to the invention can be put into effect on a snowboard boot 30. This boot 30 has a base part which is designed as a relatively stable foot shell 31 and onto which a raised heel part 35 is integrally formed. The calf rest 11 is arranged tiltably about the transverse axis 12 on the heel part 35, in basically the same manner as on heel stirrup 5 of the snowboard binding illustrated in FIGS. 1 to 4. Once again in a similar manner to that which emerges in the case of the snowboard binding from FIG. 2, stop piece 17 or shell part 16 connected to stop piece 17 or formed integrally with stop piece 17 is arranged on the calf-rest's 11 inner side facing the calf. Stop piece 17 extends downward, with a stop edge 17", beyond the lower edge 11', on the same side as the heel part of calf rest 11 and interacting with edge 22" of recess 22 on the heel-side's inner side of heel part 35 in such a manner that the tiltability of the calf rest 11 in the backward direction is limited. Once again screw 18, which passes through a vertical slot in calf rest 11 and bears in a screw-adjustable manner the nut 21', which in the example in FIG. 5, is designed as a handwheel, is firmly arranged on stop part 17 or on shell part 16. If the handwheel-shaped nut 21' is loosened sufficiently far, stop piece 17 or shell part 16 can be adjusted vertically on calf rest 11. If nut 21' is subsequently screwed tight, the respectively set position of stop piece 17 or of shell part 16 is then fixed immovably. Stop piece 17 being able to engage positively with a serration profile in a counterserration profile on the facing side of calf rest 11 in the manner illustrated in FIG. 2.

In the upper region of the shaft of boot 30, calf rest 11 may be fixed using a strap 36. This enables calf rest 11 to follow the movement of the shin of the snowboarder when the latter bends the lower leg forward. Such a strap 36 may also be provided on calf rest 11 of the snowboard binding illustrated in FIGS. 1 to 4.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A calf support on a snowboard binding or snowboard boot, said support comprising:

a base part that extends under the foot or boot of a snowboarder;

a heel stirrup arranged on the base part;

a calf rest having a rear heel portion and two connecting portions extending from opposite sides of the rear portion, the connecting portions connecting the calf rest to the heel stirrup, so that the calf rest is arranged tiltably about a transverse axis on the heel stirrup, said rear portion including a lower edge; and stopping means for limiting the tiltability in the backward direction of the calf rest, said stopping means being arranged on the rear heel portion of the calf rest and interacting with the edge on the inner side of the heel stirrup, wherein the stopping means is mounted vertically adjustably on the inner side of the calf rest and extends downward beyond the lower edge of the calf rest, wherein the stopping means includes a stop piece that interacts with the edge on the inner side of the heel stirrup, the edge on the heel stirrup being designed as part of a recess which surrounds the stop piece when the stop piece is bearing against the edge on the heel stirrup, the stop piece being on the side of the stopping means facing away from the boot or foot.

2. The calf support as defined in claim 1, wherein the stopping means includes a stop piece that interacts with the edge on the inner side of the heel stirrup, the edge on the heel stirrup being designed as part of a recess which surrounds the stop piece when the stop piece is bearing against the edge on the heel stirrup, the stop piece being on the side of the stopping means facing away from the boot or foot.

3. The calf support as defined in claim 1, wherein the edge on the heel stirrup has a wedge-shaped or curved profile and interacts with an essentially oppositely matching stop edge on a stop piece, included in the stopping means, in a centering manner in the transverse direction of the boot or foot.

4. The calf support as defined in claim 3, wherein the stop edge is elastically flexible.

5. The calf support as defined in claim 4, wherein the part of the heel stirrup interacting with the stop edge is elastically flexible.

6. The calf support as defined in claim 1, wherein the rear heel portion is rounded and wherein the stopping means forms, with its side facing the calf, a shell that is slideable along the inner side of the calf rest, the shell being shaped to conform to the rounded rear heel portion of the calf rest, and according to the adjustment of the stopping means, lengthens the calf rest downward to a greater or lesser extent.

7. The calf support as defined in claim 1, wherein the stopping means is cushioned on the calf side.

8. The calf support as defined in claim 1, wherein that side of the stopping means facing the calf has a frictionally active surface.

9. The calf support as defined in claim 1, wherein the calf rest is mounted pivotably on the heel stirrup or heel part about a transverse axis which lies slightly below the anklebones of the respective ankle in a transverse plane which passes through the anklebones and is roughly perpendicular to the base plate.

10. The calf support as defined in claim 1, wherein mutually facing surface sections of the stopping means and of the calf rest are provided with profiles which engage positively in one another.

11. The calf support as defined in claim 1 wherein the rear heel portion is rounded.

12. A calf support on a snowboard binding or snowboard boot, said support comprising:

a base part that extends under the foot or boot of a snowboarder;

a heel stirrup arranged on the base part and having an inner side with an edge;

a calf rest having an inner side with an edge, a rounded rear heel portion and two connecting portions extending from opposite sides of the rear portion, the connecting portions connecting the calf rest to the heel stirrup, so that the calf rest is arranged tiltably about a transverse axis on the heel stirrup, said rear portion including a lower edge;

stopping means for limiting the tiltability in the backward direction of the calf rest, said stopping means including a shell being arranged on the rounded rear heel portion of the calf rest and interacting with the edge on the inner side of the heel stirrup, the shell being slidable along the inner side of the calf rest and being shaped to conform to the rounded rear heel portion of the calf rest, and according to the adjustment of the stopping means, lengthens the calf rest downward to a greater or lesser extent, wherein the stopping means further includes a stop piece arranged on the side of the shell facing away from the boot or foot, the stop piece being adapted to interact with the edge on the inner side of the heel stirrup, the edge on the heel stirrup being designed as part of a recess which surrounds the stop piece when the stop piece is bearing against the edge on the heel stirrup.

13. The calf support as defined in claim 12, wherein the edge on the heel stirrup has a wedge-shaped or curved profile and interacts with an essentially oppositely matching stop edge on the stop piece in a centering manner in the transverse direction of the boot or foot.

14. The calf support as defined in claim 12, wherein mutually facing surface sections of the stop piece and of the calf rest are provided with profiles, which engage positively in one another.

* * * * *